US005426933A

United States Patent [19]

Maden et al.

[11] Patent Number: 5,426,933

[45] Date of Patent: Jun. 27, 1995

[54] DUAL FEED INJECTION NOZZLE WITH WATER INJECTION

[75] Inventors: Kenneth H. Maden, Coronado; John F. Lockyer, LaJolla, both of Calif.

[73] Assignee: Solar Turbines Incorporated, San Diego, Calif.

[21] Appl. No.: 180,153

[22] Filed: Jan. 11, 1994

[51] Int. Cl.[6] ..... F02C 3/30

[52] U.S. Cl. ..... 60/39.55; 60/742; 60/748

[58] Field of Search ..... 60/39.55, 740, 742, 60/746, 748

[56] References Cited

U.S. PATENT DOCUMENTS

| | | | |
|---|---|---|---|
| 4,023,351 | 5/1977 | Beyler et al. | 60/748 |
| 4,157,890 | 6/1979 | Reed . | |
| 4,342,198 | 8/1982 | Willis | 60/742 |
| 4,425,755 | 1/1984 | Hughes | 60/742 |
| 4,483,137 | 11/1984 | Faulkner . | |
| 4,600,151 | 7/1986 | Bradley | 60/742 |
| 5,259,184 | 11/1993 | Borkowicz et al. | 60/742 |

*Primary Examiner*—Louis J. Casaregola
*Attorney, Agent, or Firm*—Larry G. Cain

[57] ABSTRACT

Past fuel injection nozzles have attempted to provide a structure to reduce exhaust emissions, generally NOx using water injection. Such nozzles have failed to attain adequate reduction of exhaust emissions. The present fuel injector structure has resulted in reduced NOx emissions. The structure includes a combustor having an axis a first air flow passage, a second air flow passage, a first annular fuel passage and a second annular fuel passage. Positioned in the first air flow passage is a directing device through which water is introduced in a swirling manner and mixed with the air in the first air flow passage. Fuel is introduced into the first and/or second annular fuel passages and mixed with air in the second air flow passage. The mixtures of air and water, and fuel and air are mixed prior to entering the combustion section. The unique structure swirls the air and fuel and the air and water prior to their meeting and mixing.

12 Claims, 3 Drawing Sheets

DUAL FEED INJECTION NOZZLE WITH WATER INJECTION

TECHNICAL FIELD

This invention relates generally to gas turbine engines and more particularly to a dual fuel injector having the capability of injecting water therewith.

BACKGROUND ART

The use of fossil fuel in gas turbine engines results in the combustion products consisting of carbon monoxide, carbon dioxide, water vapor, particulates, unburned hydrocarbons, nitrogen oxides and sulfur oxides. Of these above products, carbon dioxide and water vapor are considered normal and unobjectionable. In most applications, governmental imposed regulations, are further restricting the remainder of the species mentioned above emitted in the exhaust gases.

In the past, the majority of the products of combustion have been controlled by design modifications. For example, at the present time particulates in the gas turbine exhaust have been controlled either by design modifications to the combustor and fuel injector or by removing them by traps and filters. Sulfur oxides are normally controlled by the selection of fuels that are low in total sulfur. This leaves carbon monoxide, unburned hydrocarbons and nitrogen oxides as the emissions of primary concern in the exhaust gases being emitted from the gas turbine engine.

Oxides of nitrogen are produced in two ways in conventional combustion systems. For example, oxides of nitrogen are formed at high temperatures within the combustion zone by the direct combination of atmospheric nitrogen and oxygen or by the presence of organic nitrogen in the fuel. The rates with which nitrogen oxides form depends mostly upon the flame temperature and, to some degree upon the concentration of the reactants. Consequently, a small reduction in flame temperature can result in a large reduction in the nitrogen oxides.

Past and some present systems provide gaseous fuel burner systems that include a burner tube and a primary burner head having a plurality of primary burner ports in a two dimensional array, over a selected, substantially planar area, transverse to the burner tube. A mixture of gaseous fuel and primary air is supplied to the burner tube, and to the primary burner ports. Secondary burner ports are provided upstream of the primary burner ports which carry the gaseous fuel and primary air in the form of jets, mixing with the secondary air, and burning to provide combustion products $CO_2$ and $H_2O$, which flow downstream with the secondary air into the combustion zone of the primary burner. An example of such a system is disclosed in U.S. Pat. No. 4,157,890 issued Jun. 12, 1979, to Robert D. Reed.

Another example of an injector nozzle is disclosed in U.S. Pat. No. 4,483,137 issued Nov. 20, 1984, to Robie L. Faulkner. The patent discloses an injector in which provision is made for introducing a liquid coolant into the combustor of the engine. This reduces the flame temperature in the combustor, thereby discouraging the formation of thermal NOx.

In an attempt to reduce NOx emissions, gas turbine combustion systems have utilized a variety of structurally configured injector nozzles. The above system and injector nozzles used therewith are examples of attempts to reduce the emissions of oxides of nitrogen.

The nozzles described above fail to efficiently mix the gaseous fluids with the combustion air, and if using water and air, to control the emissions of oxides of nitrogen emitted from the combustor.

DISCLOSURE OF THE INVENTION

In one aspect of the invention, a dual fuel injection nozzle is comprised of a combustor having a axis and a cylindrical shell positioned coaxially about the combustor axis. The cylindrical shell has a combustor end, an inlet end and has defined therein an inner bore forming a portion of a first air flow passage. An elongate cylindrical member has a combustor end generally radially aligned with the combustor end of the cylindrical shell. The cylindrical member is located in generally coaxial radially outwardly spaced relation to the cylindrical shell and defines a first annular fuel passage between the cylindrical shell and the cylindrical member. An elongate cylindrical cover has a first end and a second end having a radial inner flange attached thereto. The radial inner flange is generally axially aligned with the combustor end of the cylindrical shell and disposed in generally coaxial radially outwardly spaced relation to the cylindrical member defining a second annular fuel passage between the cylindrical member and the cylindrical cover. An end piece has a generally cup shaped configuration which defines a central opening in generally axially spaced alignment with the first air flow passage. The end piece is disposed in radially outwardly surrounding relation to the plurality of swirler vanes and defining with the cylindrical cover, the combustor ends of the cylindrical member and the cylindrical shells a second air flow passage. A means for inleting and swirling is positioned in the first air flow passage. The means for inleting and swirling includes an inlet opening and a plurality of swirler vanes positioned radially inwardly of the inlet opening.

BEST MODE FOR CARRYING OUT THE INVENTION

Figure 1:
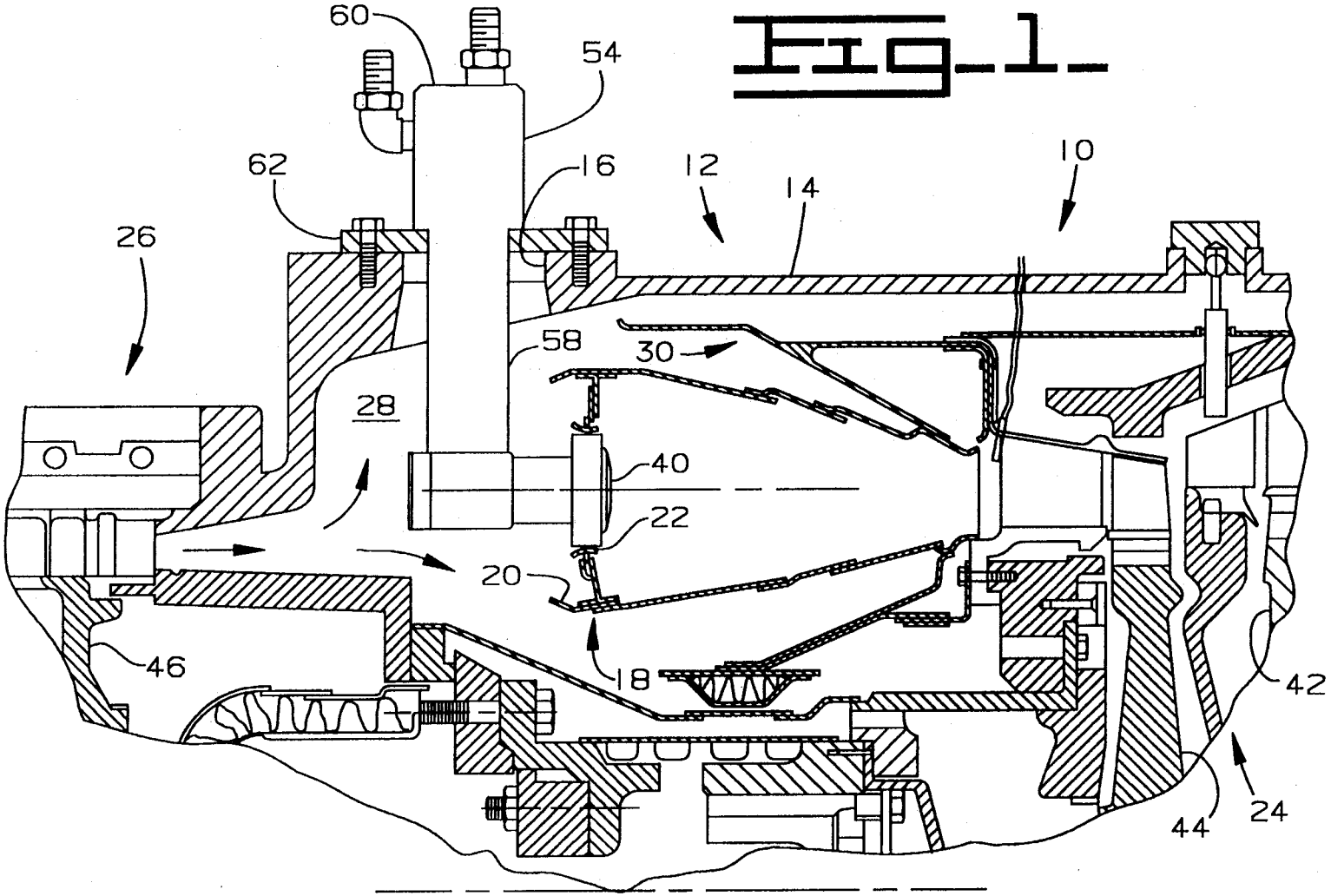
FIG. 1 is a partially sectioned side view of a portion of a gas turbine engine having an embodiment of the present invention.

Referring to FIG. 1, a gas turbine engine 10, not shown in its entirety, has been sectioned to show an air delivery system 12 for cooling engine 10 components and providing combustion air. The engine 10 includes an outer case 14 having a plurality of openings 16 therein, of which only one is shown, a combustor section 18 having an inlet end 20 defining a plurality of injector openings 22 therein, only one shown, a turbine section 24, a compressor section 26, and a compressor discharge plenum 28 fluidly connecting the air delivery system 12 to the combustor section 18. The plenum 28 is partially defined by the outer case 14 and a multipiece inner wall 30 partially surrounding the turbine section 24 and the combustor section 18. A plurality of fuel injection nozzles 40, of which only one is shown, are individually positioned in the injector openings 22 and partially within the plenum 28.

The turbine section 24 includes a power turbine 42 having an output shaft, not shown, connected thereto for driving an accessory component such as a generator. Another portion of the turbine section 24 includes a gas producer turbine 44 connected in driving relationship to the compressor section 26. The compressor section 26, in this application, includes a multistage compressor 46, although only a single stage is shown. When the engine 10 is operating, the compressor 46 causes a flow of compressed air.

Figure 2:
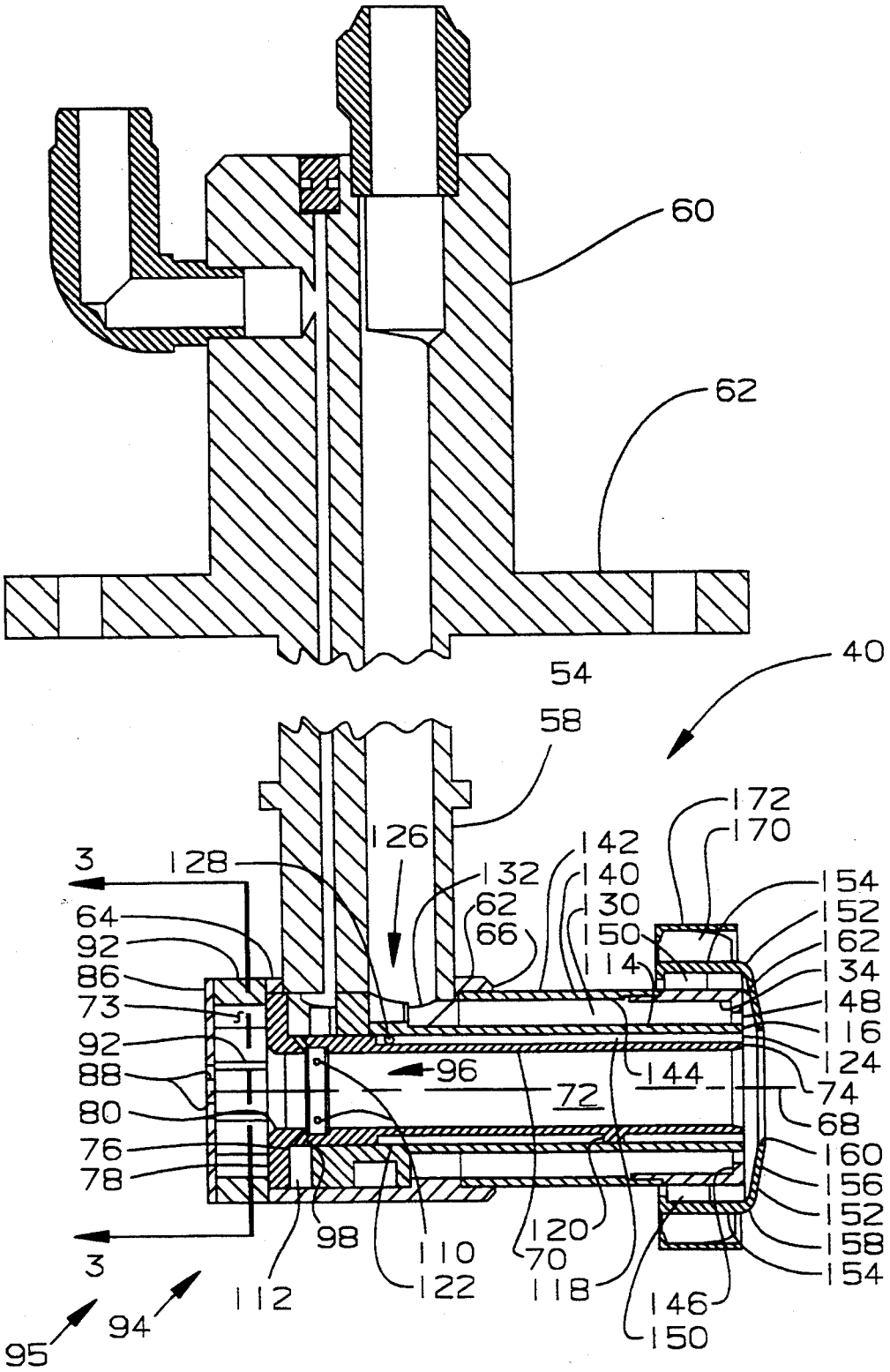
FIG. 2 is an enlarged sectional view of a fuel injection nozzle disclosing one embodiment of the present invention.

In this application and best shown in FIGS. 1 and 2, each of the fuel injection nozzles 40 is removably attached to the outer case 14 in a conventional manner. The fuel injector nozzle 40 includes an outer tubular member 54 having an outlet end portion 58 and an inlet end portion 60. The outer tubular member 54 extends radially through one of the plurality of openings 16 in the outer case 14 and has a mounting flange 62 extending radially therefrom. The flange 62 has a plurality of holes therein in which a plurality of bolts, as best shown in FIG. 1, threadedly attach to a plurality of threaded holes spaced about each of the plurality of openings 16 in the outer case 14. Thus, the injector 40 is removably attached to the outer case 14.

Figure 3:
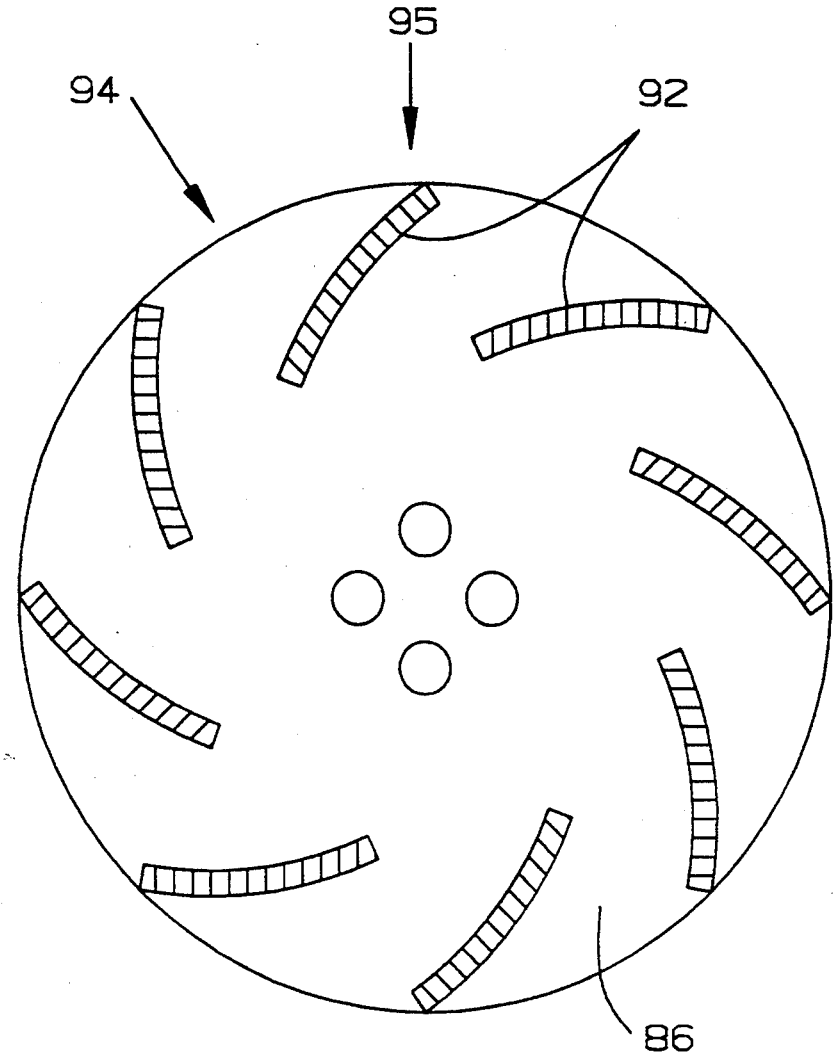
FIG. 3 is an enlarged sectional view taken along line 3—3 of FIG. 2.

The fuel injector 40 has a cylindrical outer housing 62 attached to the outlet end portion 58. The cylindrical outer housing 62 has a first end 64 and a second end 66 defined thereon. A combustor axis 68 is defined along the centerline of the cylindrical outer housing 62 and extends generally perpendicular to the outer tubular member 54. Positioned coaxially about the combustor axis 68 is an elongate cylindrical shell 70 defining an inner bore 72 forming a portion of a first air flow passage 73. The cylindrical shell 70 has a combustor end 74 and an inlet end 76. Attached to the inlet end 76 is a cylindrical first plate 78 having a central bore 80 therein being axially aligned with the inner bore 72 in the cylindrical shell 70. The cylindrical first plate 78 extends radially outwardly to the cylindrical outer housing 62 and is attached thereto near the first end 64. Spaced axially from the cylindrical first plate 78 is a cylindrical second plate 86 having a plurality of holes 88 therein being positioned near the center thereof. The plurality of holes 88 have a preestablished area and are in communication with and axially aligned with the inner bore 72 in the cylindrical shell 70. The second plate 86 is spaced from the first plate 78 a preestablished distance forming the remainder of the first air flow passage 73. A plurality of swirler vanes 92 are positioned radially inwardly of an inlet opening 94 defined between the second plate 86 and the first end 64 of the cylindrical outer housing 62, as best shown in FIG. 3. The inlet opening 94 is positioned near the radial extremity or outer surface of the second plate 86. The inlet opening 94 is in communication with the inner bore 72 in the cylindrical shell 70. A means 95 for inleting and swirling air into the first air flow passage 73 is formed by the inlet opening 94, the plurality of swirler vanes 92, the first plate 78, the first end 64 of the cylindrical outer housing 62 and the second plate 86.

A directing means 96 is positioned in the inner bore 72 near the inlet end 76 of the cylindrical shell 70. The directing means 96 includes a plurality of passages 98 having an outlet 110 being radially positioned about the inner bore 72 and having each of the plurality of passages 98 axially directed generally toward the combustor end 74 at an angle of between 90 degrees and 10 degrees to the combustor axis 68. Positioned radially outwardly about the cylindrical shell 70 and near the inlet end 76 of the cylindrical shell 70 is an annular passage 112, which in this application, is in communication with a source of water, not shown, by conventional means. The annular passage 112 is in communication with the plurality of passages 98.

Circumferentially positioned about the cylindrical shell 70 an elongate cylindrical member 114 having a combustor end 116 generally radially aligned with the combustor end 74 of the cylindrical shell 70. The cylindrical shell 70 and the cylindrical member 114 generally define a first annular fuel passage 118. A plurality of raised portions 120, of which only one is shown, extend from the cylindrical shell 70 a preestablished distance and support the cylindrical member 114. In this application, the first annular fuel passage 118 is in communication with a source of liquid fuel, not shown, in a conventional manner. The first annular fuel passage 118 has an inlet end portion 122 positioned axially between the directing means 96 and the combustor end 74. An outlet end 124 is generally aligned with the combustor end 74 of the cylindrical shell 70. Positioned near the inlet end portion 122 is a means for swirling 126 the fuel within the annular fuel passage 118 during operation of the engine 10. The means for swirling 126, in this application, includes a plurality of angled passages 128, of which only one is shown. Each of the plurality of passages are tangent to a radius from the combustor axis 68 and are angled toward the outlet end 118 at about a 10 to 90 degree angle.

A second annular fuel passage 130 is positioned radially outwardly about the cylindrical member 114. In this application, the second annular fuel passage 130 is in communication with a source of gaseous fuel, not shown, by a conventional manner. As an alternative, the first annular fuel passage 118 and the second annular fuel passage 130 could be radially interchanged without changing the scope of the invention. The second annular fuel passage 130 has a inlet end 132 and an outlet end portion 134. An elongate cylindrical cover 140 generally surrounds the second annular fuel passage 130. A first end 142 of the cylindrical cover 140 is attached to the second end 66 of the housing 62 and a second end 144 has a radial inner flange 146 attached thereto forming an annular passage or orifice 148. The radial inner flange 146 is generally radially aligned with the combustor end 74 of the cylindrical shell 70. A plurality of swirler vanes 150 are attached to the outer surface of the cylindrical cover 140 near the second end 144. A generally cup shaped end piece 152 has a straight portion 154 positioned externally of the plurality of swirler vanes 150 and axially extending at least the length of the individual swirler vanes 150. The cup shaped end piece 152 has a bottom portion 156 generally radially extending from the straight portion 154 inwardly toward the combustor axis 68. A transition portion 158 is interposed the straight portion 154 and the portion 156. The bottom portion 156 has a opening 160 positioned therein. The opening 160 radially extends from the combustor axis 68 outwardly beyond the first annular fuel passage 118 and terminates inwardly of the second annular fuel passage 130. The portion 156 is spaced from the annular passage 148 a preestablished distance. Formed between the cup shaped end piece 152 and the cylindrical cover 142, the radial inner flange 146, and an end of the cylindrical member 114 is a second air flow passage 162 having a preestablished area through which, in operation, a preestablished quantity of combustion air flows therethrough. The flow of air through the second air flow passage 162, in this application, is preferably slightly larger that the flow of air through the first air flow passage 73. For example, functionally the air flow through the second air flow passage 162 should be equal to or greater than the air flow through the first air flow passage 73. The air velocity through the second air flow passage 162 is normally high enough to penetrate and mix with the on coming air stream perpendicular to the first air flow passage 73.

Positioned externally of the straight portion 154 of the cup shaped end piece 152 is another plurality of swirler vanes 170 which are interposed between the straight portion 154 and an outer race 172. The outer race 172 is positioned in the opening 22 and is in contacting relationship with the combustor section 18.

Industrial Applicability

In use, the gas turbine engine 10 is started in a conventional manner. After the engine is warmed up and running, the fuel rate is varied depending on the load. The unique structure of the fuel injector nozzle 40 provides an excellent mixing of the fuel and air, and water and air, thus, forming a homogeneous mixture having good burning characteristics resulting in relative low NOx emissions. One important component of the injector nozzle 40 which improves the mixing therein is the plurality of radial swirler vanes 92 positioned in the first air flow passage 73. The plurality of radial swirler vanes 92 enable a larger quantity of the air to flow therethrough than does a conventional plurality of axial swirler vanes. The swirling air creates controlled turbulences as it enters the bore 72. The air has a tendency to follow along the circumference of the bore 72 and continues to swirl axially from the inlet end 76 to the combustor end 74. Near the inlet end 76 the directing means 96, more explicitly the plurality of passages 98, introduces a thin film of water. The thin film of water and air continues to swirl and mix as they travel axially along the circumference of the bore 72 toward the combustor end 74. At the combustor end 74, the rotational force causes the mixture of air and water to be expelled therefrom. The resulting mixture travels generally axially from the combustor end 74 and radially outwardly at an angle of about 30 degrees to the combustor axis 68. At the same time, either liquid fuel and/or gaseous fuel and air are exiting the second air flow passage 162 and mixing with the air and water. For example, liquid fuel enters the first annular fuel passage 118 through the swirling means 126. The liquid fuel moves axially toward the outlet end 124 of the first annular fuel passage 118 in a swirling motion. The liquid fuel exits the outlet end 124 of the first annular fuel passage 118 generally parallel to the combustor axis 68. Thus, the mixture of water and air which exits outwardly and the liquid fuel impinge and mix. Further acting on or impinging with the liquid fuel is the flow of combustion air passing through the second air flow passage 162. This air comes in contact with the liquid fuel and the mixture of air and water at generally a 90 degree angle and further causes swirling and mixing of the impinging fluids. For example, the air passing through the plurality of swirlers 150 comes in contact with the transition portion 158 and is directed along the surface of the portion 156 toward the opening 160 to intersect with the fuel and/or mixture of water and air.

When the second annular fuel passage 130 is actuated, and in this application gaseous fuel is supplied therethrough, fuel from the external source is supplied to the passage 130 and flows therealong toward the annular passage 148. As the fuel nears the annular passage 148 it strikes the radial inner flange 146 wherein turbulence occurs and the fuel exits the annular passage 148 in a turbulent state having a high velocity. The fuel comes into contact with the swirling air in the second air flow passage 162 and mixes therewith and further mixes with the mixture of air and water before exiting the opening 160.

As the flows of fuel, air and water and air travel toward the outlet or opening 160 they mix. The swirling vectors, which are additive, and the intersection angles establish uniform mixing characteristics. The incident angle of the air, fuel and mixture of air and water, the swirling of the air and water within the first air flow passage 73, the air within the second air flow passage 162, the swirling action of the fuel within the first annular fuel passage 118 and the high velocity fuel exiting the second annular fuel passage 130 allow the velocity and swirling action of the components to be additive and increases the mixing characteristics of the fuel and air. As this homogeneous mixture of fuel, air and water exits the fuel injector 40, the mixture expands reducing the velocity and momentum and intersects with additional air within the combustor section 26. Thus, mixing of the fuel, air and water and additional air further insures a good combustible mixture having burning characteristics which produce reduced NOx emissions.

The structure of the present fuel injector 40 structure has resulted in more complete mixing and more complete combustion reducing NOx emissions injector. The relative position of the first air flow passage 72, the second annular fuel passage 118 and the second air flow passage 162 and the swirling and mixing therein are a direct result of this unique structure. Thus, the use of the above described fuel injector nozzle 40 has resulted in reduced NOx emissions.

Other aspects, objects and advantages will become apparent from a study of the specification, drawings and appended claims.

We claim:

1. A dual fuel injection nozzle comprising:

an axis and an elongate cylindrical shell positioned coaxially about the axis, said cylindrical shell having an end and an inlet end and defining an inner bore forming a portion of a first air flow passage, said first air flow passage having a means for directing a fluid positioned therein including a passage axially directed generally toward the end of the cylindrical shell at an angle of between about 10 to 90 degrees;

an elongate cylindrical member having an end generally radially aligned with the end of the cylindrical shell, and located in generally coaxial radially outwardly spaced relation to the cylindrical shell and defining a first annular fuel passage between said cylindrical shell and said cylindrical member;

an elongate cylindrical cover having a first end and a second end having a radial inner flange attached thereto being generally axially aligned with the end of the cylindrical shell and disposed in generally coaxial radially outwardly spaced relation to the cylindrical member defining a second annular fuel passage between said cylindrical member and said cylindrical cover;

an end piece having a generally cup shaped configuration defining a generally central opening in generally axially spaced alignment with the first air flow passage, being disposed radially outwardly and in surrounding relation to a plurality of swirler vanes and defining with the cylindrical cover, the ends of the cylindrical member and the cylindrical shell a second air flow passage; and means for inleting and swirling being positioned in said first air flow passage, said means for inleting and swirling including an inlet opening and a plurality of swirler vanes, said plurality of swirler vanes being positioned radially inwardly of the inlet opening.

2. The dual fuel injector nozzle of claim 1 wherein said first air flow passage has a preestablished flow area and said second air flow passage has a preestablished flow area being larger than said flow area of the first air flow passage.

3. The dual fuel injector nozzle of claim 1 wherein said means for directing a fluid is in communication with a source of water.

4. The dual fuel injector nozzle of claim 1 wherein said angle is about 45 degrees.

5. The dual fuel injector nozzle of claim 1 wherein said first annular fuel passage has a means for swirling positioned therein including an angled passage being angled to the axis and directed toward the end at about a 10 to 90 degree angle.

6. The dual fuel injector nozzle of claim 5 wherein said angled passage is further positioned tangent to the first annular fuel passage.

7. The dual fuel injector nozzle of claim 1 wherein a means for directing a fluid is positioned in the first air flow passage being adapted for directing a flow of water radially and axially along a circumference of the inner bore during operation of the nozzle.

8. The dual fuel injector nozzle of claim 7 wherein said inleting and swirling means and said directing mean being adapted for swirling a flow of air introduced into said first air flow passage and mixing with said flow of water during operation of the nozzle.

9. The dual fuel injector nozzle of claim 1 wherein said first annular fuel passage has a means for swirling positioned therein and said second air flow passage being adapted to mixing a flow of swirling air with a flow of swirling fuel during operation of the nozzle.

10. The dual fuel injector nozzle of claim 1 wherein said second air flow passage being adapted to having a flow of air and fuel exiting therefrom and said first air flow passage being adapted for swirling a flow of air and a flow of water being mixed therein and exiting therefrom during operation of the nozzle.

11. The dual fuel injector nozzle of claim 10 wherein said second air flow passage being adapted to having the flow exiting therefrom intersecting the flow of air and water exiting said first air flow passage at a preestablished angle during operation of the nozzle.

12. The dual fuel injector nozzle of claim 11 wherein said preestablished angle at which said flow exiting from said second air flow passage intersects the flow exiting the first air flow passage is 90 degrees.

* * * * *